US009186931B2

(12) United States Patent
Jolls

(10) Patent No.: US 9,186,931 B2
(45) Date of Patent: Nov. 17, 2015

(54) VACUUM SEALABLE PAINT TRAY LINER

(71) Applicant: Justin E. Jolls, Buffalo, NY (US)

(72) Inventor: Justin E. Jolls, Buffalo, NY (US)

( * ) Notice: Subject to any disclaimer, the term of this patent is extended or adjusted under 35 U.S.C. 154(b) by 0 days.

(21) Appl. No.: 14/525,469

(22) Filed: Oct. 28, 2014

(65) Prior Publication Data

US 2015/0114968 A1 Apr. 30, 2015

Related U.S. Application Data

(60) Provisional application No. 61/897,952, filed on Oct. 31, 2013.

(51) Int. Cl.

| | |
|---|---|
| ***B44D 3/12*** | (2006.01) |
| ***B65D 33/01*** | (2006.01) |
| ***B65D 30/24*** | (2006.01) |

(52) U.S. Cl.

CPC ..... *B44D 3/126* (2013.01); *B65D 31/14* (2013.01); *B65D 33/01* (2013.01)

(58) Field of Classification Search

CPC ..... B44D 3/126; B44D 3/12; B65D 31/14; B65D 33/01; B65D 51/1644; B65D 51/1633

USPC ..... 220/495.02, 495.01, 570, 203.19, 220/203.28, 203.29, 203.04, 203.01, 367.1; 15/257.06; 206/1.9; 383/3, 45, 44, 100

See application file for complete search history.

(56) References Cited

U.S. PATENT DOCUMENTS

| | | | | |
|---|---|---|---|---|
| 3,157,902 | A | 11/1964 | Hardwick | |
| D208,969 | S | 10/1967 | Paxton | |
| 3,514,012 | A | 5/1970 | Martin | |
| 3,757,990 | A * | 9/1973 | Buth | B44D 3/126 206/223 |
| 4,765,123 | A | 8/1988 | Caldwell | |
| 5,121,590 | A * | 6/1992 | Scanlan | B65B 31/047 137/533.21 |
| 5,480,030 | A * | 1/1996 | Sweeney et al. | B65D 33/1666 206/522 |
| 5,887,708 | A | 3/1999 | Gonzales | |
| 6,581,641 | B2 * | 6/2003 | Skeens et al. | B65D 47/247 137/1 |
| 7,614,203 | B2 * | 11/2009 | Oltrogge | B65D 81/2038 53/139.2 |
| 2004/0134917 | A1 | 7/2004 | Carnegie | |
| 2006/0037960 | A1 | 2/2006 | Rosa | |
| 2012/0006825 | A1 | 1/2012 | Morla | |

* cited by examiner

*Primary Examiner* — Robert J Hicks

(57) ABSTRACT

An assembly including a paint tray liner for protecting a paint tray from coming in contact with paint being held within the tray. The assembly includes a flexible plastic member having a generally rectangular shape and including an open end to receive the paint tray within the flexible plastic member, a sealing strip coupled to the flexible plastic member located proximate to the open end of the flexible plastic member, and a vacuum valve coupled to a side of the flexible plastic member to remove air from the flexible plastic member to create a vacuum within the flexible plastic member and form the flexible plastic member to the contours of the paint tray. Also shown are methods of manufacturing and using the paint tray liner.

7 Claims, 6 Drawing Sheets

VACUUM SEALABLE PAINT TRAY LINER

RELATED APPLICATION

This application claims the benefit of U.S. Provisional Application No. 61/897,952, filed on Oct. 31, 2013. The entire teachings of the above application are incorporated herein by reference.

BACKGROUND OF THE INVENTION

Common equipment utilized in the painting of household and commercial surfaces are a paint roller and paint tray. However, after completing a painting job, trays are often difficult to clean, causing a mess, additional cleaning time, and inconvenience. Typical trays can also leave a dried-on paint residue that can ruin future painting projects. The vacuum sealable paint tray liner described herein provides a convenient, and effective solution to the issue described above.

SUMMARY OF THE INVENTION

Through utilization of a flexible plastic bag as a liner for a paint tray (the flexible plastic bag being vacuum sealable to ensure a more-perfect contour to the paint tray and an easy cleanup, saving both time and frustration for the user), embodiments of the present invention are able to alleviate issues involving use of a typical paint tray. Use of the disclosed paint tray liner can preserve a paint tray by preventing the tray from contacting the paint liquid, and by doing so, enables a user to re-use the paint tray multiple times without having to clean, dispose of, or purchase a new paint tray. The vacuum-sealable feature creates an air-tight seal to the contours of the tray, thereby making use of the tray more effective.

In one example embodiment, such a paint tray liner includes a flexible plastic member having a generally rectangular shape and including an open end to receive the paint tray within the flexible plastic member. The paint tray liner also includes a sealing strip coupled to the flexible plastic member that is located proximate to the open end of the flexible plastic member. The sealing strip enables selective sealing of the open end of the flexible plastic member. The paint tray liner also includes a vacuum valve coupled to one side of the flexible plastic member. The vacuum valve connects to a suction device to remove air from the flexible plastic member after the open end of the flexible plastic member is sealed to create a vacuum within the flexible plastic member and form the flexible plastic member to the contours of the paint tray.

In some example embodiments, the vacuum valve includes a push-pull closure allowing closing of the vacuum valve while the suction device is attached to the valve. Such a valve may be made of injection-molded acrylonitrile butadiene styrene, for example. An some embodiments, the sealing strip includes a membrane that resists forces originating outside of the flexible plastic member. The flexible plastic member can be made from a wide variety of materials and can be of a variety of sizes. In some particular embodiments, the flexible plastic member is made of polyethylene with a thickness in the range of 0.5 to 1 one-thousandth of an inch, and is at least eighteen inches wide and twenty inches long.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
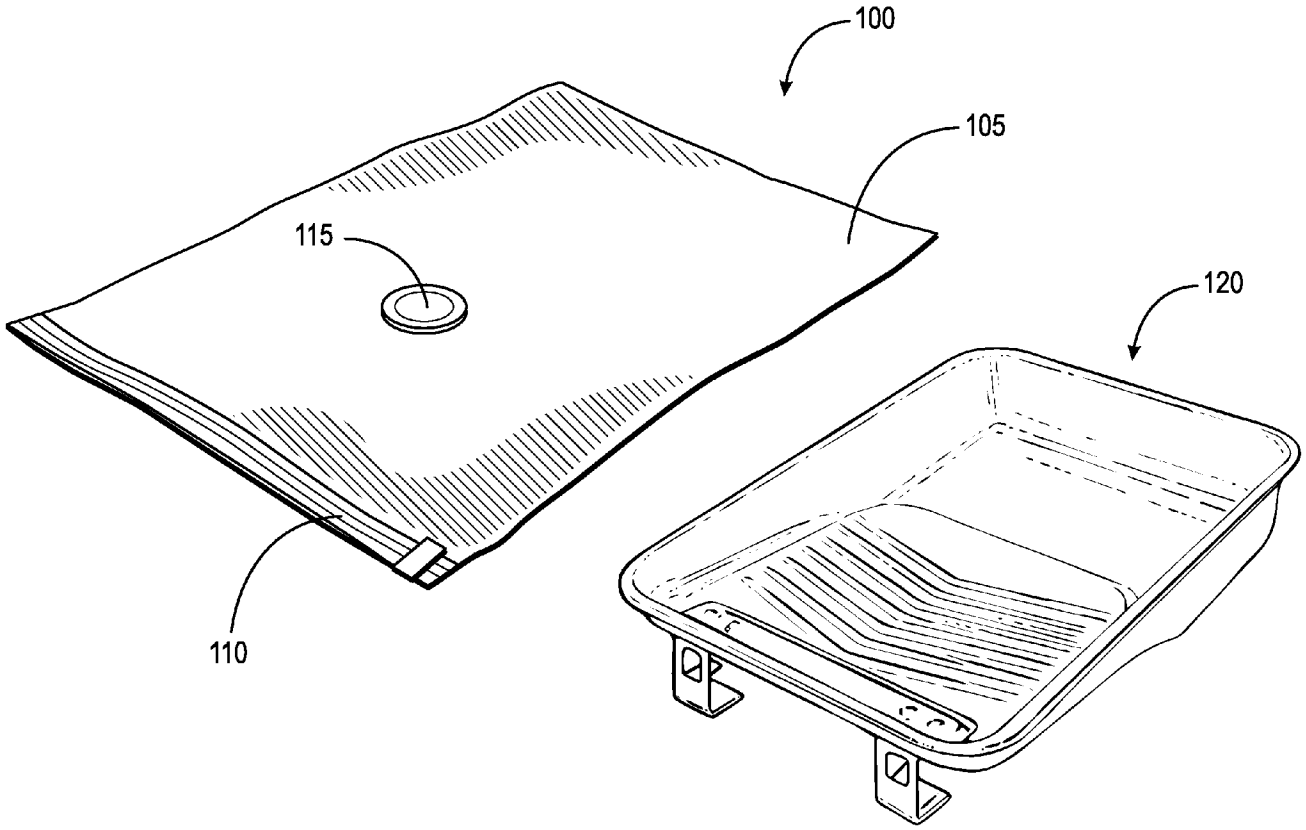
FIG. 1 is a drawing illustrating an example embodiment of the disclosed paint tray liner next to a typical steel paint tray.
Figure 2B:
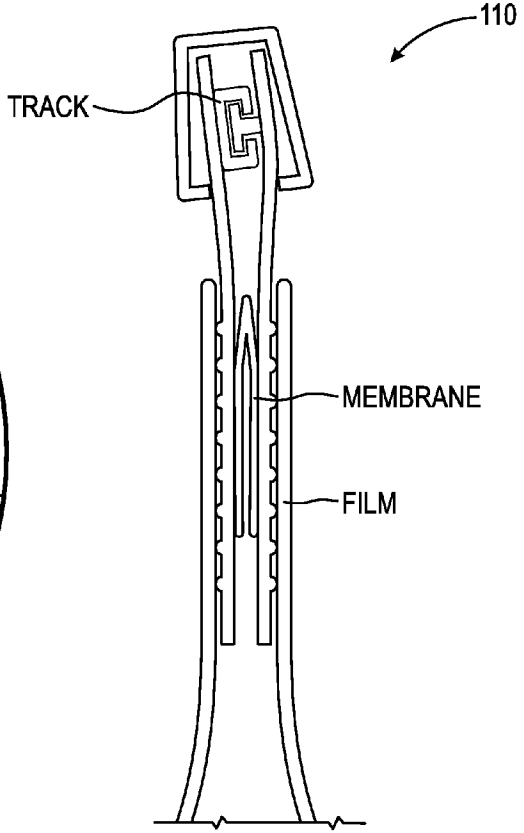
FIGS. 2A and 2B are drawings illustrating an example sealing strip with membrane that can be used in constructing the paint tray liner.
Figure 2A:
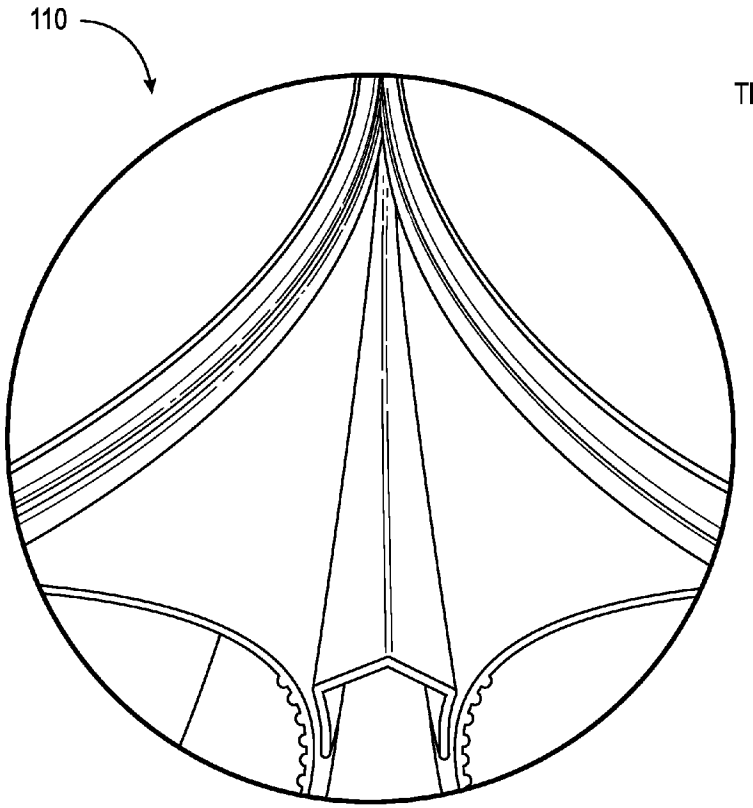

An example paint tray liner 100, as illustrated in FIG. 1, includes a sealing strip 110 across one end of a flexible plastic bag 105 and a vacuum valve 115 on one side of the bag 105. The vacuum valve 115 is configured to connect to a suction device to remove air from the bag 105 to create an air tight seal to the contours of a paint tray 120 placed within the bag 105. The body 105 of the paint tray liner can be made of 0.5-1 mil (0.5-1 1/1000 of an inch) polyethylene, for example. The sealing strip 110 can be made of any sliding zipper-type strip, for example. One example of a preferred sliding zipper is a zipper such as the Slide-Rite® Easy-Open Track, depicted in FIGS. 2A and 2B. The Slide-Rite® Easy-Open Track includes a membrane designed to resists forces originating from the inside of a bag. One example modification to such a sliding zipper is to reverse the membrane so that it resists forces originating from the outside of a bag, thus helping to keep an air-tight seal. A ribbed zipper can also be used for the sealing strip 110. The vacuum valve 115 can be any one-way valve for vacuum-sealing a bag, such as the type of value used on typical evacuatable, resealable storage bags.

Figure 3A:
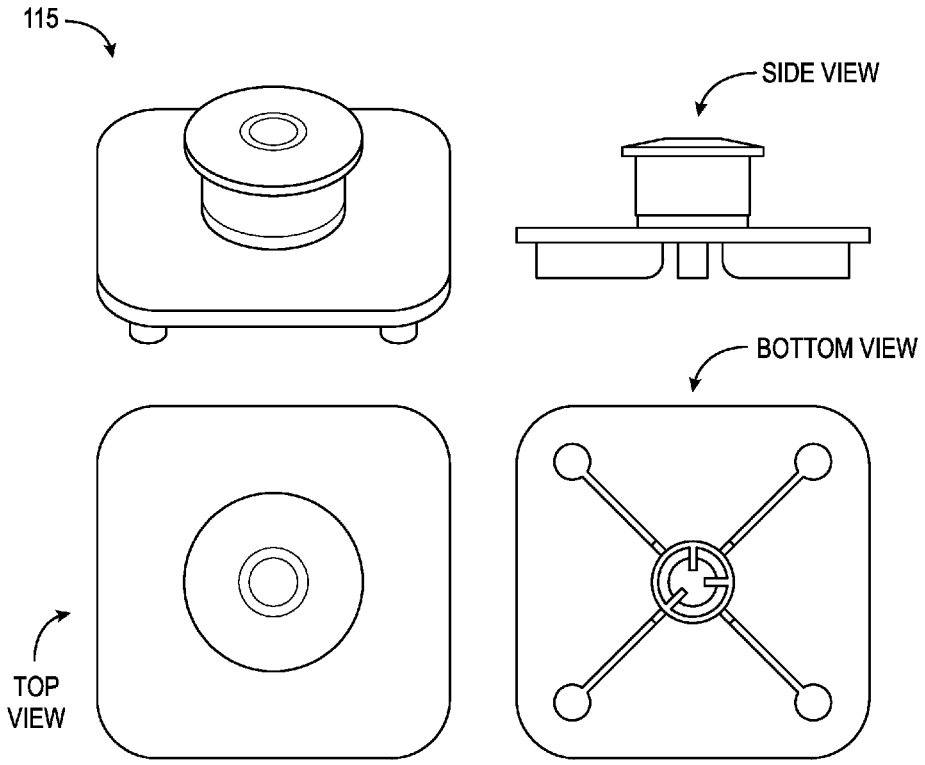
FIGS. 3A and 3B are drawings illustrating an example push-pull closure vacuum valve that can be used with the paint tray liner.
Figure 3B:
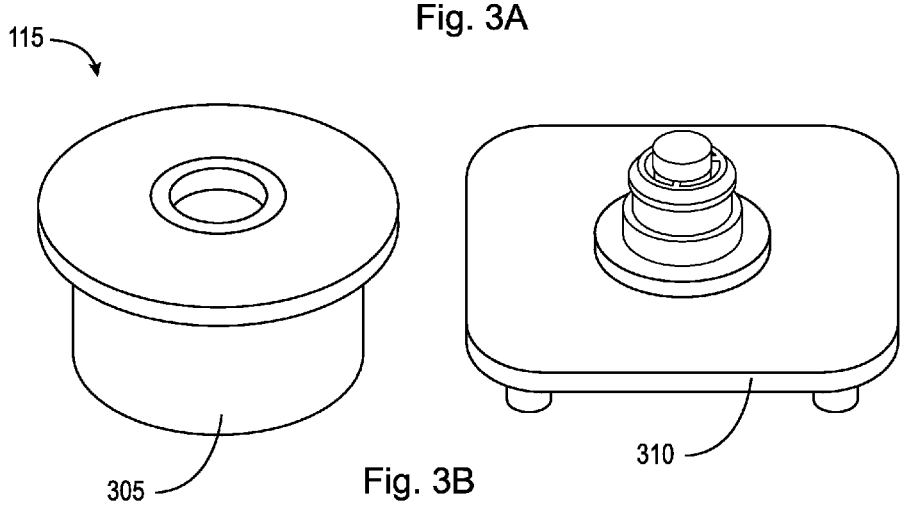

One example of a preferred vacuum valve 115 is a valve as depicted in FIGS. 3A and 3B. FIG. 3A shows the value 115 from a perspective view, side view, top view, and bottom view. Such a valve 115 utilizes a push-pull bottle-type closure attached to a base, to which the paint tray liner is heat sealed during assembly. The push-pull closure allows the valve to be opened or closed while a suctioning device is still attached to the valve 115, allowing for the maximum vacuum to be obtained without losing vacuum pressure. This contrasts with a typical valve that would lose vacuum during the time between removal of the suction device and closing of the valve. The proper way to utilize the disclosed push-pull closure valve 115 is to open the valve by pulling up on the push-pull closure prior to attaching the suction device. Once the suction device is attached, the device should be turned on, therefore removing the air contained within the zipped liner bag. Once the air is removed from the liner bag 105 (FIG. 1) and the ideal level of vacuum suction is reached, the user can apply downward force on the push-pull closure while the suction device is still attached and running Pressure should be applied until the valve 115 is completely closed ensuring a tight seal, which will maintain the desired level of vacuum suction between the liner bag and the paint tray. A preferred material for molding the vacuum valve is acrylonitrile butadiene styrene (ABS). ABS may be injected into a two-part mold in which the valve base and valve top are injection molded for assembly once a curing period has occurred. An example two-part valve including the valve top 305 and valve base 310 is shown in FIG. 3B.

Figure 4A:
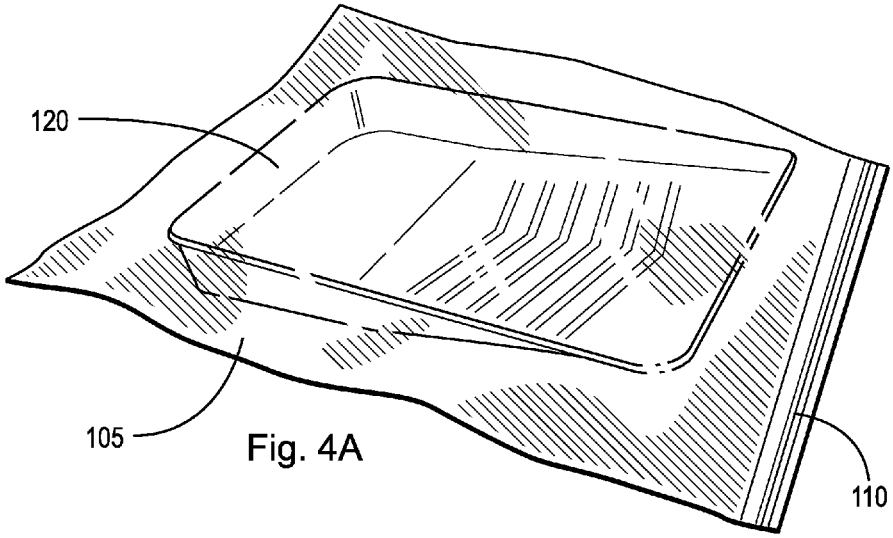
FIG. 4A is a drawing illustrating a sealed paint tray liner.
Figure 4B:
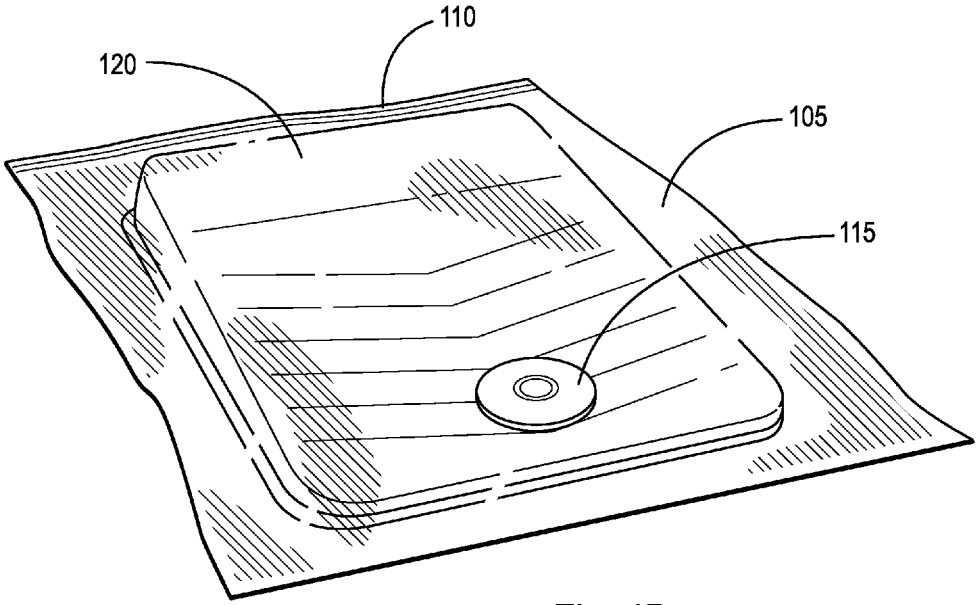
FIG. 4B is a drawing illustrating an example placement of the vacuum valve of the paint tray liner with respect to the paint tray.

One example process of using the disclosed paint tray liner 100 is to place a paint tray 120 within the flexible plastic member 105, as shown in FIG. 4A, with the vacuum valve 115 oriented on the bottom side of the tray 120, as shown in FIG. 4B. The user can then seal the sealing strip 110 across one end of the bag 105. Once sealed, the user can connect the vacuum valve 115 to a household suction device (e.g., household vacuum, air mattress pump, or lung power etc.). After connecting the suction device to the vacuum valve 115 and turning on the device, the air will be removed from the bag 105, creating an air-tight seal to the contours of the paint tray 120. After air is removed, the user can close the valve 115 while the suction device is still engaged, therefore ensuring a strong vacuum seal. After use of the tray 120 with liner 100, the sealing mechanism 110 can be unsealed, and the liner 100 can be reversed, keeping the remaining paint liquid contents within the liner 100, and the user can dispose of the used liner 100 according to municipal laws for paint material disposal.

The completely enclosed design of the disclosed paint tray liner 100 is one of the features that differentiates it from prior inventions in the paint tray covering art. An example of this difference can be viewed in U.S. Pat. No. 3,757,990, for a "Disposable flexible liner for paint trays." U.S. Pat. No. 3,757,990 uses a single sheet of polyethylene film that is held in place by clips or a drawstring. Embodiments of the present disclosure, on the other hand, differ in that they use an enclosable, sealable bag 100 that completely surrounds the entire paint tray 120, compared to only lying in the paint well. The enclosed design of the present embodiments also differs from U.S. Pat. No. 3,757,990 in that the enclosed design allows the consumer to reverse the liner 100 when their use of the paint tray is complete, which encases the remaining paint liquid inside of the liner 100 and allows for easy disposal of both the paint liquid and liner 100. U.S. Pat. No. 3,757,990 provides a drawstring with its liner to tie the ends of the liner together, eventually coming to a similar entrapment of the paint liquid but the result is reached in an inefficient and prolonged manner, and may not be entirely sealed.

Another example difference can be viewed in U.S. Pat. No. 3,514,012, for a "Paint Tray Cover." Embodiments of the present disclosure differ in that the present embodiments provide an completely enclosable liner 100, instead of a partial enclosure provided by the paint tray cover in U.S. Pat. No. 3,514,012. The present embodiments provide a design advantage in terms of consumer usability of the invention and the ability of the invention to prevent the liner from sliding within a paint tray well when a paint roller is rolled against the liner.

Another example difference can be viewed in comparison to U.S. Design Pat. No. D208,969, for a "Paint roller tray liner." The tray of Pat. No. D208,969 is a rigid vacuum-formed liner that sits in a paint tray well to prevent liquid paint from coming into contact with paint tray. The liner of Pat. No. D208,969 does not surround the tray and is fabricated of rigid plastic materials instead of pliable materials. Pat. No. D208,969 is also limiting in the scope of how many different paint tray sizes, brands, and designs the liner can effectively be used with. In comparison, the presently-disclosed vacuum sealable paint tray liner 100 can be used with virtually any paint tray size or design, without specific design limitations.

Another differentiator of the present embodiments is the vacuum sealing component 115. Applicant is not aware of any prior art pertaining to paint tray protection/preservation that utilize the methodology of vacuum suction to create and maintain the contours of the paint tray 120. In the above-discussed example prior liners (U.S. Pat. Nos. 3,757,990, 3,514,012, and D208,969), all examples use different methods (e.g., clips, drawstrings, or formed objects) to line the paint tray. The vacuum-seal methodology for creating and maintaining contour with the paint tray is superior in that a consumer can effectively utilize all of the features built into the underling paint tray 120, such as the ribs for even paint distribution along a roller and the tray's feet, which are utilized to secure the tray to a step ladder, while at the same time gaining the convenience of a paint tray liner 100.

Figures 5A, 5B:
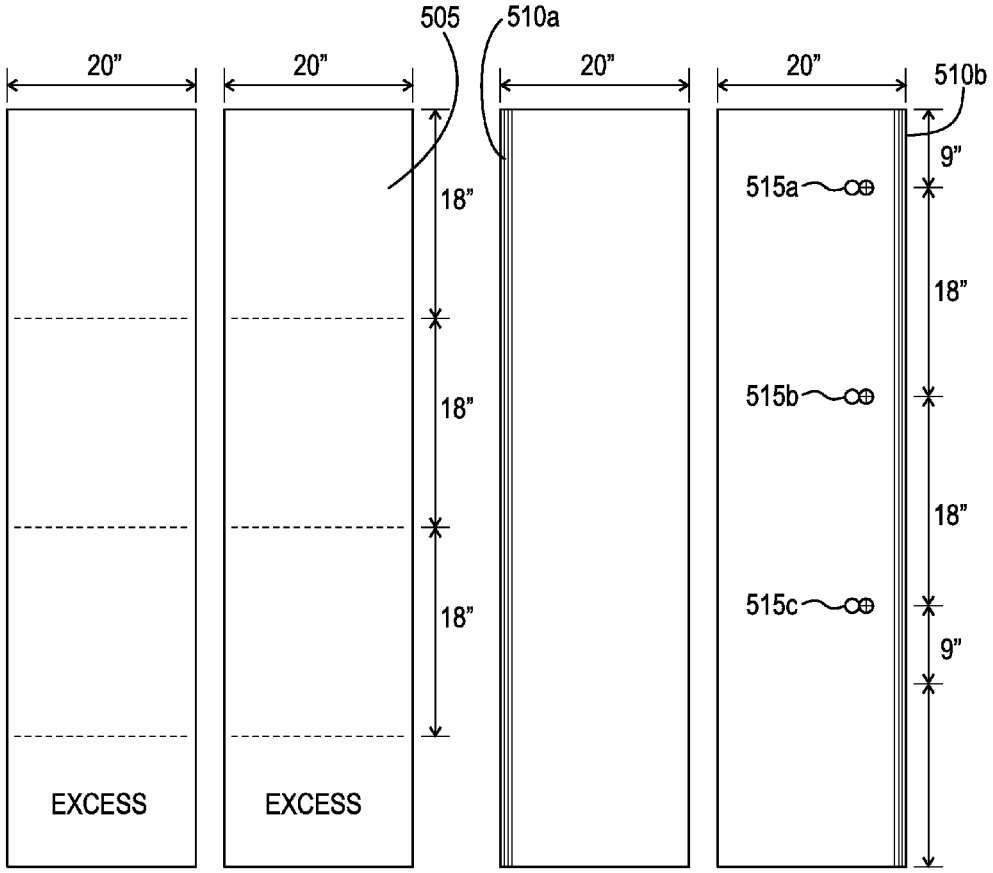
FIGS. 5A-5D are schematic drawings illustrating an example process for constructing a paint tray liner, according to one example embodiment.
Figure 5C:
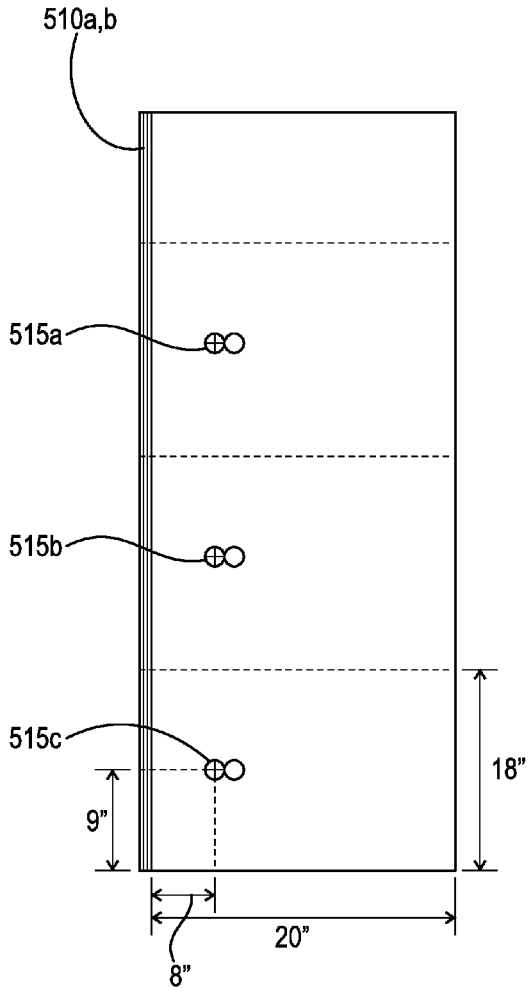
Figure 5D:
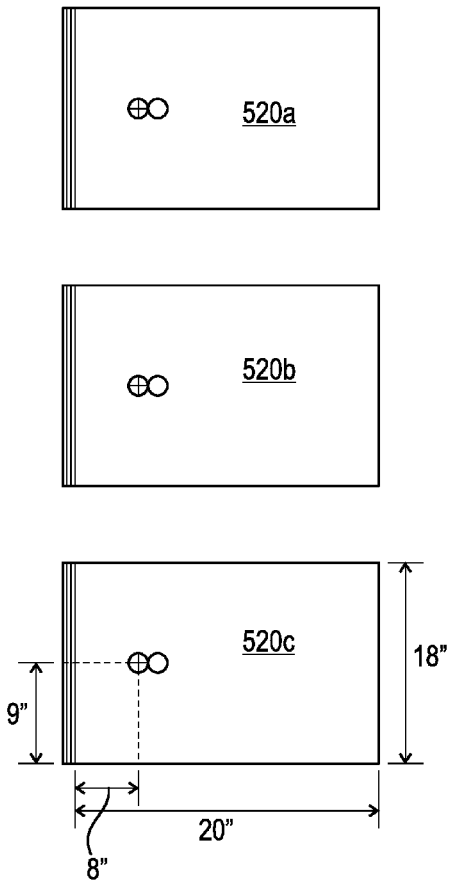

An example assembly process for the disclosed paint tray liner is illustrated in FIGS. 5A-5D. A polyethylene sheet 505 measuring 40 inches wide, for example, may be used to make multiple paint tray liners (FIG. 5A). A zipper sealing strip 510*a,b* may be adhered to ½ inch from the edge of the sheet 505 (FIG. 5B). Once the zipper sealing strip 510*a,b* is adhered, vacuum valves 515*a-c* may be installed, for example, 8 inches from the end of the sheet with the sealing strip, and 9 inches from the edge of each paint tray liner (FIG. 5B). After the strip 510*a,b* and valves 515*a-c* are installed and sealed, the sheet can folded in half, making sure to align and interlock the corresponding parts 510*a,b* of the zipper sealing strip (FIG. 5C). The next step is to heat-seal the paint tray liners 520*a-c* using, for example, an impulse poly heat sealer, while also separating the finished paint tray liners 520*a-c* into individual liners measuring about 18 inches by 20 inches, for example, each having one end with a zipper sealing strip and a vacuum sealing valve strategically located on the bag to be placed on the underside of a paint tray (FIG. 5D).

While this invention has been particularly shown and described with references to example embodiments thereof, it will be understood by those skilled in the art that various changes in form and details may be made therein without departing from the scope of the invention encompassed by the appended claims.

What is claimed is:

1. A paint tray liner for preventing paint from coming into contact with a paint tray, the paint tray liner comprising:

a flexible plastic member having a generally rectangular shape and including an open end to receive the paint tray within the flexible plastic member;

a sealing strip coupled to the flexible plastic member proximate to the open end of the flexible plastic member and configured to enable selective sealing of the open end of the flexible plastic member; and a vacuum valve coupled to a side of the flexible plastic member and configured to connect to a suction device to remove air from the flexible plastic member after the open end of the flexible plastic member is sealed to create a vacuum within the flexible plastic member and form the flexible plastic member to the contours of the paint tray, the vacuum valve including a two-part push-pull closure allowing closing of the vacuum valve while the suction device is attached to the valve, the vacuum valve configured to be closed by pushing the two parts of the closure together while the suction device is attached and activated to prevent loss of vacuum pressure.

2. A paint tray liner as in claim 1 wherein the vacuum valve is made of injection-molded acrylonitrile butadiene styrene.

3. A paint tray liner as in claim 1 wherein the sealing strip includes a membrane configured to resist forces originating outside of the flexible plastic member.

4. A paint tray liner as in claim 1 wherein the flexible plastic member includes polyethylene with a thickness in the range of 0.5 to 1 one-thousandth of an inch.

5. A paint tray liner as in claim 1 wherein the flexible plastic member is at least eighteen inches wide and at least twenty inches long.

6. A method of preventing paint from coming into contact with a paint tray, the method comprising:

placing the paint tray within a paint tray liner including (i) a flexible plastic member having a generally rectangular shape and including an open end to receive the paint tray within the flexible plastic member, (ii) a sealing strip coupled to the flexible plastic member proximate to the open end of the flexible plastic member and configured to enable selective sealing of the open end of the flexible plastic member; and (iii) a vacuum valve coupled to a side of the flexible plastic member and configured to connect to a suction device to remove air from the flexible plastic member after the open end of the flexible plastic member is sealed to create a vacuum within the flexible plastic member and form the flexible plastic member to the contours of the paint tray;

sealing the open end of the flexible plastic member;

connecting a suction device to the vacuum valve;

removing air from the paint tray liner using the suction device to create a vacuum within the flexible plastic member and to form the flexible plastic member to the contours of the paint tray; and closing the vacuum valve while removing the air from the paint tray liner before detaching the suction device.

7. A method as in claim 6 wherein placing the paint tray within the paint tray liner includes placing the paint tray within the paint tray liner with the vacuum valve positioned at a bottom of the paint tray.

* * * * *